United States Patent [19]

Harak

[11] 4,340,463

[45] Jul. 20, 1982

[54] SYSTEM FOR UTILIZING OIL SHALE FINES

[75] Inventor: Arnold E. Harak, Laramie, Wyo.

[73] Assignee: The United States of America as represented by the United States Department of Energy, Washington, D.C.

[21] Appl. No.: 243,307

[22] Filed: Mar. 13, 1981

[51] Int. Cl.[3] ..... C10G 1/00; C10G 1/02

[52] U.S. Cl. ..... 208/11 R; 208/8 R; 202/108; 202/109; 201/31

[58] Field of Search ..... 208/8 R, 11 R; 201/31, 201/37, 28, 39, 42; 202/108, 109

[56] References Cited

U.S. PATENT DOCUMENTS

| | | | |
|---|---|---|---|
| 3,501,394 | 3/1970 | Lyons | 208/11 R |
| 4,102,773 | 7/1978 | Green et al. | 208/8 |
| 4,146,359 | 3/1979 | Lumpkin et al. | 201/37 X |

*Primary Examiner*—Delbert E. Gantz
*Assistant Examiner*—Glenn A. Caldarola
*Attorney, Agent, or Firm*—Harold M. Dixon; Roger S. Gaither; Richard G. Besha

[57] ABSTRACT

A system is provided for utilizing fines of carbonaceous materials such as particles or pieces of oil shale of about one-half inch or less diameter which are rejected for use in some conventional or prior surface retorting process, which obtains maximum utilization of the energy content of the fines and which produces a waste which is relatively inert and of a size to facilitate disposal. The system includes a cyclone retort (20) which pyrolyzes the fines in the presence of heated gaseous combustion products, the cyclone retort having a first outlet (30) through which vapors can exit that can be cooled to provide oil, and having a second outlet (32) through which spent shale fines are removed. A burner (36) connected to the spent shale outlet of the cyclone retort, burns the spent shale with air, to provide hot combustion products (24) that are carried back to the cyclone retort to supply gaseous combustion products utilized therein. The burner heats the spent shale to a temperature which forms a molten slag, and the molten slag is removed from the burner into a quencher (48) that suddenly cools the molten slag to form granules that are relatively inert and of a size that is convenient to handle for disposal in the ground or in industrial processes.

11 Claims, 2 Drawing Figures

SYSTEM FOR UTILIZING OIL SHALE FINES

BACKGROUND OF THE INVENTION

Processes for recovering oil from carbonaceous material such as oil shale, typically utilize particles of a size of about one-half inch to 3½ inches diameter. Particles of about one-half inch diameter and less, which are commonly referred to as fines, are removed from the feed stock, since they can cause channeling in the retort wherein the fines fuse and block the retorting gas flow except along limited areas where there is consequent overheating. Such fines, which are typically particles less than one-half inch diameter and wherein the average fines size is about one-quarter inch, may represent about 10% of the oil shale. The inability to effectively utilize such fines wastes an appreciable portion of the mined oil shale, and also constitutes a waste that may be difficult to dispose of. Among the many reasons for the difficulty in disposal are the large quantities involved. Also disposal presents problems because of the presence of organic material that may seep into the environment when the waste is buried, and because the dust present in the fines may increase the cost of handling it.

OBJECTS OF THE INVENTION

One object of the present invention is to provide a method and apparatus utilizing fines of carbonaceous materials such as oil shale, to obtain oil or other energy sources therefrom.

Another object is to provide a system for extracting fuel or energy from fines of carbonaceous material while forming a waste product that is easily handled and disposed of.

Another object is to provide a system for utilizing fines of carbonaceous material, which extracts oil therefrom utilizing equipment that operates at high efficiency in the utilization of energy and in the avoidance of breakdowns.

SUMMARY OF THE INVENTION

In accordance with one embodiment of the present invention, a system is provided for productively utilizing fines of carbonaceous material. The system includes a retort for pyrolyzing the fines to produce at least vapors (i.e. typically gas, vapors and liquid) that can be condensed into oil, as well as to produce spent shale. The system also includes a burner for burning the spent shale in air, to produce hot gaseous combustion products that are returned to the retort to provide a hot substantially non-oxydizing medium in which the fines are pyrolyzed. In short, the combustion of spent shale provides at least part of the heat for the pyrolysis through heat exchange of the hot gaseous products with the fresh fines.

The retort can include a cyclone chamber with an inlet through which fines and the gaseous combustion products are delivered. The chamber has a periphery which is of circular cross section, and the inlet extends largely tangential to the chamber to circulate the incoming fines and hot gas (i.e. fluidized fines) along the chamber.

The burner in which the spent shale is burned to provide gaseous combustion products for the pyrolyzer, can heat the spent shale so that the ash exits the burner in a molten state. The molten ash is quenched in water to granulize it. The resulting granules are relatively inert and provide a form of waste that is easy to handle.

The novel features of the invention are set forth with particularity in the appended claims. The invention will be best understood from the following description when read in conjunction with the accompanying drawings.

DESCRIPTION OF THE PREFERRED EMBODIMENT

The present invention relates to a system for utilizing fines such as those of oil shale, which are the small particles that result from various mining and crushing operations that are performed on oil shale. The larger particles, of a size such as about one-half inch to 3½ inches, may be processed as in a column retort wherein the shale particles are dropped into the top of an enclosed oil shale column while a limited amount of air and recycled product gas flows through the column to heat the oil shale and convert most of the kerogen therein to oil and gas. Some converting processes avoid the use of fines, which are small particles less than about one-half inch diameter, or about one centimeter, and which have an average size (by weight, i.e. fines under about one-quarter inch comprise half the total weight of fines) of perhaps one-quarter inch, or about one-half centimeter. In some systems, the fines if used can fuse together and hamper the retorting process. However, about 10% of oil shale obtained after the crushing process is in the form of fines, and the wasting of the fines results in the wastage of substantial oil and energy, and also results in a disposal problem.

Figure 1:
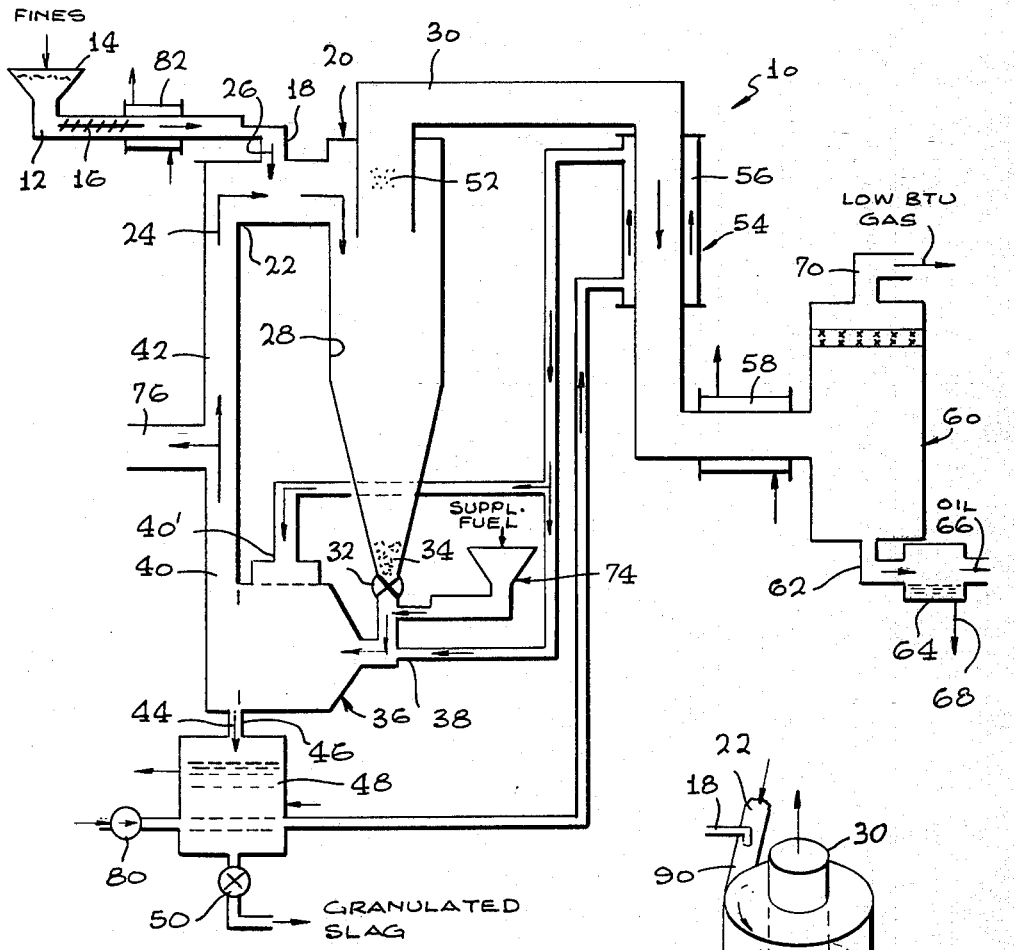
FIG. 1 is a diagrammatic view of a system for utilizing fines, which is in accordance with the present invention.

FIG. 1 illustrates a system for utilizing carbonaceous fines such as those of oil shale, to produce additional oil and other fossil derived products, to provide energy that can be utilized at the site. For example, the fines produce energy which can be used to produce electrical power, and also the fines produce an essentially inert and uniform size waste that can be easily disposed of either in the ground or utilized in industry. The system includes a shale feeder 12 having a hopper 14 for receiving the fines and a screw feeder 16 for advancing the fines into an inlet 18 of a retort system 20. The retort system includes another inlet 22 for receiving hot substantially nonoxidizing gases that provide the heat to enable operation of the retort. By substantially nonoxidizing gas is meant gases having very little and preferably no free oxygen present to oxidize oil shale products in the cyclone retort. The particular gases 24 received through the inlet 22 are flue gases which are combustion products. As contemplated here, some oxygen (air) enters the retort, however, most of the gases are nonoxidizing. The shale oil fines 26 and hot gases 24 enter a cyclone retort chamber 28 of the retort system, where the heat of the gases 24 heat the fines to pyrolyze them. The reaction releases a gas-oil mist as well as some shale dust, all of which exit the chamber through an outlet 30. The larger pyrolyzed fines drop to the bottom of the cyclone chamber and are removed through an outlet 32.

The spent shale at 34 which passes through the retort outlet 32, enters a cyclone furnace or burner 36 where it is burned with air delivered through inlets 38 and 40' of the burner. The burner operates at a relatively high temperature such as about 2,400° F., which substantially completely oxidizes organic material on the spent shale. The gaseous combustion products, or flue gases 24, leave the burner through an outlet 40. A portion of the hot gases 24 are carried by a conduit 42 from the burner outlet 40 to the retort inlet 22. Accordingly, the non-oxidizing hot gases are utilized in the retort chamber 28 to fluidize and pyrolyze the fresh fines 26.

As a result of burning the spent shale (and supplementary fuel), ash 44 is generated which is at a temperature sufficiently high that it is molten. The molten ash 44 leaves the burner through an outlet 46 and immediately enters a quencher 48, where the molten ash is dropped into water. The quenching operation granulizes the ash. Accordingly, relatively inert ash particles are generated, which are of a uniform size which is large enough to avoid dust problems. Such granules can be readily disposed of, either by using them as land fill, or in industrial processes such as to form lightweight aggregate products. Thus, the heat generated by the burner 36 not only produces the hot non-oxidizing gases utilized in the retort, but also enables the ash waste product to be readily converted to a form that facilitates disposal. The granulated ash or slag exits the quencher 48 through an outlet 50 where it can be transported away.

A product of the cyclone retort 20 is the gas-oil mist, together with some shale dust, shown at 52, which leaves the retort through the outlet 30, and which must be cooled to recover the oil therein. Some cooling occurs first along a heat exchanger 54, where heat in the gas-oil mist is delivered to the incoming air 56 that is utilized in the burner. The partially cooled gas-oil mist passes through another heat exchanger 58 where it is cooled to a much lower temperature by cooling water, and enters an entrainment separator 60. The separator 60 has an outlet 62, where the oil, together with water mixed therein, is recovered. This mixture can be passed through a separator 64 which delivers oil 66 that can be stored for later use as fuel, and has another outlet 68 which delivers the separated water.

The entrainment separator 60 has another outlet 70 through which volatile components of the product obtained from the retort are recovered, which are components that do not condense at the moderate temperatures to which the gas from the retort has been finally cooled. This gas in outlet 70 is a relatively low btu gas, but still contains substantial amounts of energy. It can be employed to operate a turbine to produce electricity. It is also possible to deliver the low btu gas to the cyclone burner 36 so as to aid in the burning of the spent shale, except that a low btu gas may not produce the required high temperature in the burner without considerable preheating of the gas. Additional fuel for increasing the temperature in the burner 36 to assure a molten ash or slag, can be delivered thereto through a feeder 74 that can feed a high btu fuel such as coal into the burner. The high temperatures in the burner that assure a molten slag, result in the production of more flue gases exiting through the outlet 40, than are required for operation of the retort system 20. Excess flue gases can be removed through a conduit 76 for other uses, such as steam production for electrical generation.

The air utilized in the burner 36, is initially blown in by a blower 80 through the water bath of the quencher 48, to cool the water so as to minimize its use and to heat the air. The somewhat heated air passes through the heat exchanger 54 to additionally heat it and cool the gas-oil mist from the retort. Finally, the heated air is delivered through the inlet 38 to help carry the spent shale particles and supplemental coal or other fuel into the burner, as well as through an inlet 40 to supply additional air for burning the material in the burner. Additional heat exchangers can be utilized in the system, such as at 82 to preheat the oil shale fines as by utilizing the gas-oil mist from the retort or the hot flue gases such as at 76.

As mentioned earlier, fines with an average size on the order of one-quarter inch have not been utilized in some retorts because a static or slow moving column containing such fines tends to become plugged at least in part due to the fines fusing together. It may be noted that it has been suggested that very fine particles can be pyrolyzed by injecting them through a nozzle into a chamber containing a largely nonoxidizing gas. However, the problem presented in the utilization of fines such as those left in the obtaining of oil from oil shale, are of about ½ inch size and less and additional effort would be required to crush those particles to a small size and handle the resulting dust. In the present invention, the moderately small particles of up to about ½ inch diameter, are effectively pyrolyzed by the use of the cyclone retort system 20 and the spent shale more easily handled and disposed of.

Figure 2:
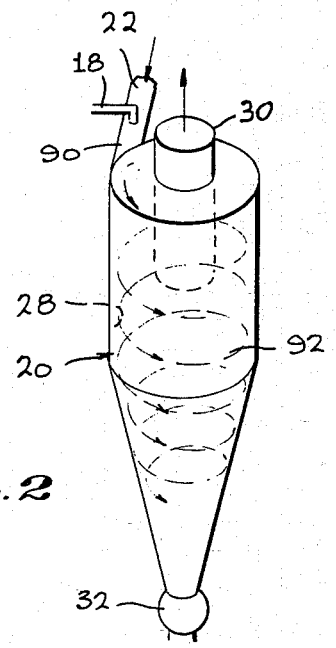
FIG. 2 is a partial perspective view of the cyclone retort of the system of FIG. 1.

As shown in FIG. 2, the cyclone retort 20 includes a combined inlet 90 through which the oil shale fines and flue gases are delivered to the retort chamber 28. The retort chamber 28 has a periphery of circular cross section, which is substantially uniform along the upper portion of the chamber and which is of decreasing diameter along the lower portion. The combined inlet 90 is directed tangentially to the chamber 28, to form a cyclone, vortex, or a spiral movement of the fines and hot gases. The cyclone action provides a long path-length indicated at 92, along which the fines and hot gases move, relatively rapidly to maintain the fines in suspension or fluidized within the chamber 28 for a period of several seconds which is required to pyrolyze the larger of the fines. The cyclone action also tends to maintain the larger and heavier particulates near the periphery of the retort chamber, while allowing gases, oil vapors and oil mist, or droplets recovered from the pyrolyzed fines to flow towards the middle of the chamber to find their way into the outlet 30. The combined inlet 90 is located near the top of the vertically-extending chamber 28, so that the larger fines move in a downward helix until they reach the bottom of the chamber where they collect and can be removed. The gas outlet 30 is near the top of the chamber. Thus, the use of a cyclone to keep particles of a size such as up to perhaps one-half inch diameter in contact with the hot gases, while avoiding the fusing together of the fines that could cause their joining together, facilitates the pyrolyzing of the fines.

One system has been designed, as shown in the figures, for processing shale oil fines of a size of one-half inch diameter and less, and with an average size of one-quarter inch. The properties of the oil shale charge are as listed in the following table:

| PROPERTIES OF SHALE CHARGE | |
|---|---|
| Fischer Assay | 27.7 gpt |
| Shale Density | 135 lb/cu ft. |
| Bulk Density approximately | 81 lb/cu ft. |

-continued

| PROPERTIES OF SHALE CHARGE | |
|---|---|
| Particle Size less than | 0.5 inch |

| Raw Shale Dried At 221° F. for 1 Hour | Weight % |
|---|---|
| Mineral $CO_2$ | 18.90 |
| Carbon (total) | 17.59 |
| Carbon (organic) | 12.43 |
| Hydrogen | 1.77 |
| Nitrogen | 0.41 |
| Sulfur | 0.63 |
| Ash | 65.68 |
| Gross Heating Value | 2,590 Btu/lb |

The shale is supplied to the hopper 14 at nearly room temperature and is heated in the heat exchanger 82 to about 600° F. The flue gas entering the retort at inlet 22 is at approximately 2,400° F. The fines are heated to approximately 1,000° F. in the retort chamber 28. The retort chamber 28 is of a diameter of about 9 feet and a height of about 37 feet, to permit the processing of about 1,000 tons of oil shale fines per day. The residence time of the oil shale fines in the retort environment of about 1,000° F. is about six seconds. The linear velocities through the retort are about 18 feet per second.

The spent shale particles exiting the retort, together with coal particles supplied from the hopper 74 and primary air supplied through the inlet 38, are introduced tangentially to the cyclone burner 36. Small particles of solid fuel burn upon entering the burner, while larger particles are thrown outwardly by centrifugal force and stick in the molten slag lining the circumference of the burner where they are burned. The cyclone burner has a diameter of about 8 feet and a length of about 11 feet, which is more than sufficient to handle 1,000 tons of oil shale per day. The temperature in the burner is about 2,400° F. The main temperature requirement of the burner is to assure that spent shale is provided as a molten slag that can be quenched to produce a granulated waste product in the quencher 48. More flue gas exiting from the burner at the outlet 40 is generated than is needed to heat the shale fines in the retort chamber 28 to the processing temperature therein. As discussed above, the excess is delivered over a conduit 76 to other apparatus such as for generation of electricity.

The temperature in the retort chamber 28 of about 1,000° F. is chosen to provide relatively high yields of liquid hydrocarbons (after cooling to near room temperature) in reasonable reaction times. Such yields can be obtained at retorting temperatures above about 900° F., and a 1000° F. temperature assures such reaction. Temperatures much above 1,000° F. yield decreasing amounts of liquid in favor of gases, and the liquids tend to contain higher proportions of aromatic compounds. The temperature of about 2,400° F. in the cyclone furnace can generate a molten slag, although higher temperatures provide better assurance of rapid and complete melting of all slag but require more supplementary fuel and produce somewhat greater energy losses from the burner.

The system can be operated as described above, but with the burner 36 operating at 2,800° F. to assure that all ash, or slag is molten. For such a case illustrative inputs and outputs of various components of the system and other parameters are described hereafter to aid practice of the invention. For an input to the cyclone retort chamber 28 of one ton shale fines of the properties listed above at 600° F., and 570 pounds of flue gas combustion products at 2,800° F., the output of the retort includes the following products that are all at 1,000° F.: 162 pounds oil, 10 pounds water, 80 pounds gas, 1748 pounds spent shale, and 570 pounds combustion products (the designation oil or water indicates the state when cooled to room temperature). The input to the cyclone furnace includes 1748 pounds spent shale at 1,000° F., 2625 pounds of air at 1,000° F. and 261 pounds of coal at 77° F. The output of the furnace (all at 2,800° F.) includes 3325 pounds of gaseous combustion products, and 1310 pounds of slag. The amount of coal supplied to the furnace can be reduced by operating it at a somewhat lower temperature such as 2,400° F., but the exact temperature must be controlled to assure that molten slag is produced. In the slag quenching apparatus 48, the input is 1310 pounds of slag at 2,800° F., 2628 pounds of air at 77° F., and 1398 pounds of cooling water at 77° F. The output includes 2625 pounds of air at 212° F., 1310 pounds of slag at 212° F., and 1398 pounds of water and steam at 212° F.

Thus, the invention provides a system for utilizing fines of carbonaceous material such as oil shale, not only to derive energy therefrom in the form of oil and gas that can be burned and hot combustion products that can be utilized as to operate an electrical generator at the site, but which also facilitates disposal by forming the solid waste as substantially inert granules. This is accomplished by pyrolyzing the fines in hot flue gases, in a retort, and utilizing the spent shale which exits the retort to supply much of the fuel in a burner that generates the hot flue gas. The burner is operated at a high enough temperature, which is greater than required to produce molten slag from the burner. The molten slag can be immediately quenched to produce relatively inert granulated slag that is easily disposed of. The retort operates on a cyclone principal, wherein the fines and hot flue gases enter tangentially to move in a spiral through the retort, to keep the fines suspended in the hot flue gases. This cyclone process helps avoid the formation of clinkers which can occur in other retorts as a result of the fusing together of small particles. Furthermore, according to the present invention, a retort chamber which is relatively small in size is adequate because the pyrolysis occurs rapidly. The cyclone retort enables such pyrolyzing to be performed with relatively small particles that can be suspended in a rapidly moving gas stream, including relatively large particles of up to about one-half inch size as well as very small particles.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. Apparatus for utilizing fines of carbonaceous material, of a size on the order of magnitude of one-half inch and less, comprising:

a cyclone retort chamber having an inlet for receiving said fines and hot gases, and having means for circulating fines around said chamber whereby said fines are maintained in a fluidized state with hot gases in said chamber, a gas outlet for removing at least gas from said chamber, and a spent fine outlet for removing spent fine material from said chamber; and a burner having an inlet coupled to said spent fine outlet of said retort, for burning said spent fine material to generate substantially oxygen-free gaseous combustion products, said burner having an outlet connected to said inlet of said retort for supplying hot gas thereto which is formed of substantially oxygen-free combustion products.

2. The apparatus described in claim 1 wherein: said means for circulating fines includes said inlet being constructed to extend largely tangential to said cyclone chamber to circulate incoming material in a fluidized state around the chamber.

3. Apparatus for utilizing carbonaceous fines, comprising:

a retort having a first inlet for receiving fines, a second inlet for receiving hot substantially nonoxidizing gas, a first outlet for removing gas, and a second outlet for removing spent fines;

cooling means coupled to said first outlet for cooling hot gas to recover oil therein;

a burner having a first inlet coupled to said second retort outlet for receiving spent fines, a second inlet for receiving air to burn the spent fines, a first outlet for removing flue gas, and a second outlet for removing molten ash;

means coupling said first burner outlet to said second retort inlet for delivering flue gas from said burner to said retort; and means for quenching molten ash, connected to said second burner outlet, to provide a granular waste.

4. The apparatus described in claim 3 including:

means for applying supplementary fuel to said burner, to heat the spent fines to a temperature at which substantially the coal ash is molten.

5. The apparatus described in claim 3 wherein:

said retort includes a retort chamber with a periphery of circular cross-section, and said retort inlets are coupled to said chamber to introduce said fines and nonoxidizing gas substantially tangentially to said chamber to fluidize and move in largely a helix therein.

6. Apparatus for utilizing fines of carbonaceous material, of a size on the order of magnitude of one-half inch and less, comprising:

a cyclone retort chamber having an inlet for receiving said fines and hot gases, and having means for circulating fines around said chamber whereby said fines are maintained in a fluidized state with hot gases in said chamber, a gas outlet for removing at least gas from said chamber, and a spent fine outlet for removing spent fine material from said chamber; and a burner having an inlet coupled to said spent fine outlet of said retort, for burning said spent fine material to generate substantially oxygen-free gaseous combustion products, said burner having an outlet connected to said inlet of said retort for supplying hot gas thereto which is formed of substantially oxygen-free combustion products;

means coupled to said burner to supply supplementary fuel to heat the inside of the burner to supply supplementary fuel to heat the inside of the burner to a temperature at which the ash therein is molten, said burner having an ash outlet for eliminating said ash heated to a fluid state; and quenching means connected to said ash outlet for quenching the molten ash thereby to form granules and simultaneously generate hot gases for the retort.

7. A process for utilizing and disposing of carbonaceous fines, comprising:

pyrolyzing said fines with hot substantially nonoxidizing gases in a retort having a cyclone chamber, by maintaining said fines circulating around the chamber in a fluidized state with hot substantially non-oxidizing gas, removing gas from the retort, and removing spent fines from the retort;

cooling the gas removed from the retort to recover oil therefrom;

burning the removed spent fines in a burner to generate hot flue gases and heat said spent fines to a temperature at which the resulting ash is molten; and carrying at least part of the hot flue gas from the burner to the cyclone chamber of said retort to supply hot nonoxidizing gas utilized therein.

removing the molten ash from the burner and quenching it to form a granular waste.

8. The method described in claim 7 wherein:

said step of burning includes applying high energy supplementary fuel to said burner, to raise the temperature therein to a level at which the ash is molten.

9. The method described in claim 7 including:

carrying at least some of the volatile components, that remain after said cooling of gas removed from the retort, to said burner to burn said volatile components.

10. The method described in claim 7 wherein:

said fines includes particles up to about one-half inch diameter, and said step of retorting includes passing said fines and hot non-oxidizing gases in a substantially tangential direction into a retort chamber having a periphery of circular cross-section, whereby said fines are maintained in a fluidized state in said chamber, and moving fluidized fines and gas in a largely helical path along said chamber.

11. The method described in claim 7 wherein:

said step of burning spent fines includes burning them with supplementary fuel in an amount to generate a temperature of at least about 2,400° F. to assure that the ash is molten, even though excess flue gas needed in said cyclone retort is generated thereby, and quenching the molten ash.

* * * * *